US009501924B2

(12) United States Patent
Kennedy et al.

(10) Patent No.: US 9,501,924 B2
(45) Date of Patent: Nov. 22, 2016

(54) HOME SECURITY SYSTEM WITH AUTOMATIC CONTEXT-SENSITIVE TRANSITION TO DIFFERENT MODES

(71) Applicant: Google Inc., Mountain View, CA (US)

(72) Inventors: Zachery Webster Kennedy, San Jose, CA (US); Ted Boda, San Jose, CA (US); Jeffrey Alan Boyd, Novato, CA (US); Jeffery Theodore Lee, Los Gatos, CA (US); Jesse Boettcher, San Jose, CA (US); David Hendler Sloo, Menlo Park, CA (US); Michael Mizono, San Francisco, CA (US); Tomas Brennessl, Palo Alto, CA (US); James Simister, San Francisco, CA (US); Anton Davydov, Gilroy, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/585,223

(22) Filed: Dec. 30, 2014

(65) Prior Publication Data

US 2016/0189526 A1 Jun. 30, 2016

(51) Int. Cl.
*G08B 13/00* (2006.01)
*G08B 25/00* (2006.01)

(52) U.S. Cl.
CPC ..... *G08B 25/008* (2013.01); *G08B 13/00* (2013.01)

(58) Field of Classification Search
CPC ..... G08B 25/008; G08B 13/00
USPC ..... 340/541
See application file for complete search history.

(56) References Cited

U.S. PATENT DOCUMENTS

| | | | | |
|---|---|---|---|---|
| 7,403,109 | B2 | 7/2008 | Martin | |
| 7,978,069 | B2 | 7/2011 | Wu | |
| 8,510,255 | B2 | 8/2013 | Fadell et al. | |
| 2001/0048030 | A1* | 12/2001 | Sharood | G05B 19/00 236/49.3 |
| 2003/0071739 | A1 | 4/2003 | Addy et al. | |
| 2004/0032326 | A1 | 2/2004 | Nakamura et al. | |
| 2004/0145458 | A1 | 7/2004 | DiCroce et al. | |
| 2006/0181401 | A1* | 8/2006 | Martin | G08B 15/002 340/506 |
| 2007/0063840 | A1 | 3/2007 | Jentoft et al. | |

(Continued)

FOREIGN PATENT DOCUMENTS

| | | | |
|---|---|---|---|
| DE | 3701136 | A1 | 10/1988 |
| DE | 102008022276 | A1 | 11/2009 |

(Continued)

OTHER PUBLICATIONS

International Search Report and the Written Opinion of the International Searching Authority for PCT/US2015/061155 dated Feb. 9, 2016.

(Continued)

*Primary Examiner* — Juan A Torres
(74) *Attorney, Agent, or Firm* — Morris & Kamlay LLP

(57) ABSTRACT

A home security system may infer a mode of operation based on indications it receives regarding a user's behavior. The disclosed implementations provide for a vacation mode of operation that defines a response for a security event that differs from the response that would be provided by the home security system for the same security event if it operated in another mode such as an away mode.

14 Claims, 7 Drawing Sheets

(56) References Cited

U.S. PATENT DOCUMENTS

| | | | | |
|---|---|---|---|---|
| 2007/0220907 | A1* | 9/2007 | Ehlers | F25B 49/005 62/126 |
| 2007/0247302 | A1* | 10/2007 | Martin | G08B 25/008 340/506 |
| 2008/0018474 | A1 | 1/2008 | Bergman et al. | |
| 2008/0068162 | A1 | 3/2008 | Sharma et al. | |
| 2008/0094203 | A1 | 4/2008 | Kogan et al. | |
| 2008/0157964 | A1 | 7/2008 | Eskildsen et al. | |
| 2008/0238669 | A1 | 10/2008 | Linford et al. | |
| 2009/0140056 | A1* | 6/2009 | Leen | F24F 11/0086 236/49.3 |
| 2010/0019902 | A1 | 1/2010 | Mullet et al. | |
| 2010/0127854 | A1 | 5/2010 | Helvick et al. | |
| 2010/0242368 | A1 | 9/2010 | Yulkowski et al. | |
| 2011/0046805 | A1 | 2/2011 | Bedros et al. | |
| 2012/0186774 | A1* | 7/2012 | Matsuoka | G05B 15/02 165/11.1 |
| 2013/0163619 | A1 | 6/2013 | Stephanson et al. | |
| 2013/0173064 | A1* | 7/2013 | Fadell | G05D 23/1902 700/276 |
| 2013/0245838 | A1* | 9/2013 | Zywicki | G05D 23/1905 700/278 |
| 2013/0338839 | A1* | 12/2013 | Rogers | G05D 23/1904 700/278 |
| 2014/0191862 | A1 | 7/2014 | Haines | |
| 2014/0218181 | A1 | 8/2014 | Musham et al. | |
| 2014/0266669 | A1 | 9/2014 | Fadell et al. | |
| 2014/0292481 | A1 | 10/2014 | Dumas et al. | |
| 2014/0313032 | A1 | 10/2014 | Sager et al. | |
| 2015/0308178 | A1 | 10/2015 | Warren et al. | |

FOREIGN PATENT DOCUMENTS

| | | | |
|---|---|---|---|
| DE | 102013103535 | A1 | 10/2014 |
| EP | 1713045 | A2 | 10/2006 |
| EP | 2393071 | A2 | 12/2011 |
| WO | 2014154738 | A1 | 10/2014 |

OTHER PUBLICATIONS

Notification of Transmittal of the International Search Report and the Written Opinion of the International Searching Authority for PCT/US2015/067366, dated Apr. 21, 2016.

PCT/US2015/067820, International Search Report and Written Opinion issued in PCT/US2015/067820 on Apr. 6, 2016.

* cited by examiner

HOME SECURITY SYSTEM WITH AUTOMATIC CONTEXT-SENSITIVE TRANSITION TO DIFFERENT MODES

CROSS-REFERENCE TO RELATED APPLICATIONS

This application is related to U.S. application Ser. No. 14/585,295, filed Dec. 30, 2014, and Ser. No. 14/585,222, filed Dec. 30, 2014, the contents of which are hereby incorporated by reference in their entirety.

BACKGROUND

A home security system may operate in two modes that may be generally referred to as an "away" mode or a "home" mode. The home security system may operate in an "away" mode, for example, when the occupants of the home are away for a period of time no more than 24 hours at a time (e.g., at work during the day). While operating in the away mode, the entry points for the home may be monitored for intrusion. A "home" mode may refer to the home security system's state when the occupants are home. For example, it may detect motion utilizing passive infrared sensors and activate interior lights in response thereto. The home security system may ignore a window or door being opened (or in any event, not trigger an intrusion alarm) while in the home mode. Thus, the mode of the home security system can affect the actions taken by the home security system in response to sensed activities in the home. While a user can manually program the timing of home and away states, the home security system may not automatically determine when a user is away from the home for an extended period of time such as on a long work trip or a vacation.

BRIEF SUMMARY

According to an implementation of the disclosed subject matter, a home security system may receive a first indication that a user is not on a premises of a home on a first day. The home security system may be placed into an away mode based on the first indication. The away mode may define a first response for a security event. The first indication may be received on a second day. The home security system may be placed into the away mode based on the first indication. The user may be determined to not returning for an extended time based on a second indication. The home security system may be placed into a vacation mode. The vacation mode may define a second response for the security event. The second response may be different from the first response. The security event may be detected. The second response may be generated based on the home security system operating in the vacation mode. The second response may be provided.

A home security system is disclosed in an implementation that includes a plurality of sensors that observe a premises of a home for a security event. A processor may be communicatively coupled to the plurality of sensors. The processor may be configured to receive a first indication that a user is not on the premises of the home on a first day. The processor may be configured to place the home security system into an away mode based on a second indication. The away mode may define a first response for the security event. The processor may receive the first indication on a second day and place the home security system into the away mode based on the first indication. The processor may be configured to determine that the user will not return for an extended time based on a second indication. It may place the home security into a vacation mode that may define a second response for the security event. The second response may be different from the first response. The processor may be configured to detect the security event and generate the second response based on the home security system operating in the vacation mode. The processor may provide the second response.

Additional features, advantages, and implementations of the disclosed subject matter may be set forth or apparent from consideration of the following detailed description, drawings, and claims. Moreover, it is to be understood that both the foregoing summary and the following detailed description provide examples of implementations and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

Figure 1:
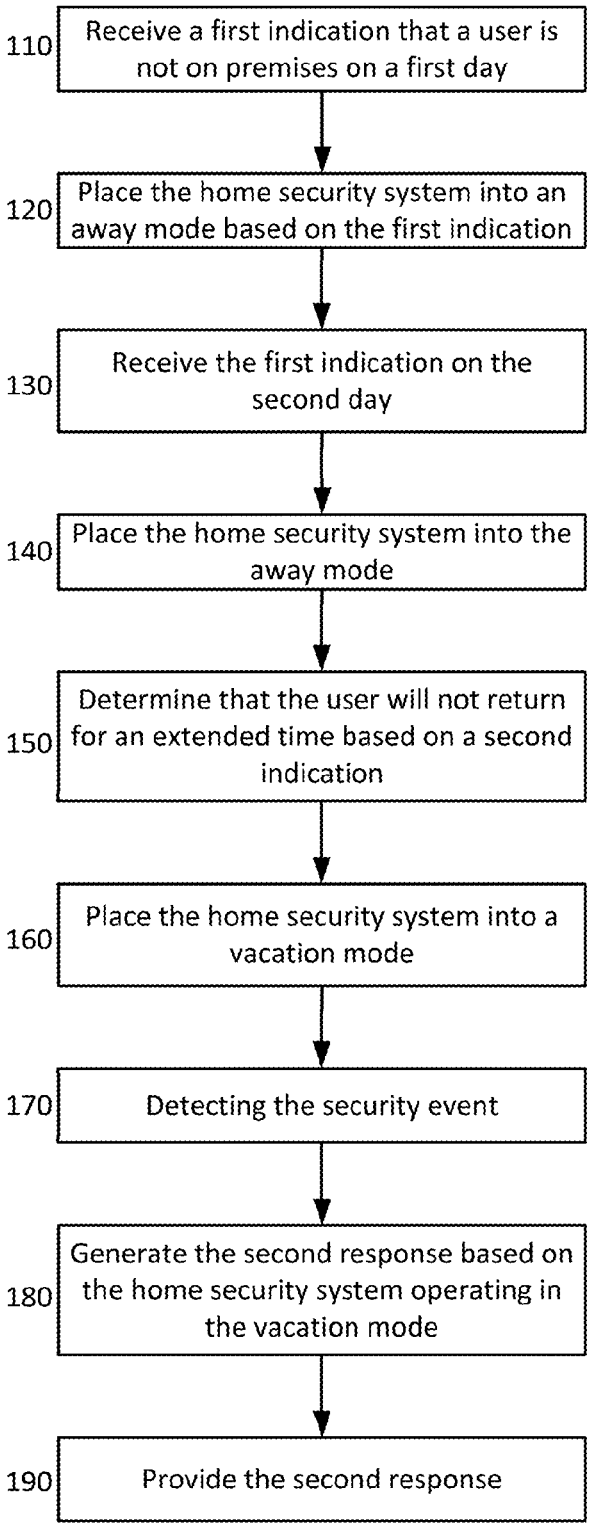
FIG. 1 is an example of a process for placing a home security system into a vacation mode as disclosed herein.

The disclosed implementations provide for a context aware home security system that can learn or otherwise determine an appropriate mode for the system. Typically, a home security system requires a user to program a controller of the home security system with a schedule to indicate when the system should transition between modes. In some instances, a user may place a home security system into an away state by, for example, by entering a code into a door keypad and/or a controller associated with the system as the user is leaving the premises of the home. The disclosed implementations do not require a user to indicate manually the occupancy of the premises and/or the user's presence on the premises. In an implementation, an extended away mode or vacation mode is disclosed. An away mode may be utilized for relatively short-term absences such as a twenty minute errand (e.g., going to the store) or a workday (e.g., the user is absent from the home for ten hours). The vacation mode differs from the away mode described above because it can provide specific features that can deter intrusion and/or observation of the home while the home is unoccupied for a longer period of time, such as described below. In an implementation, the system can "learn" usage of the home's devices (e.g., interior/exterior lights, heating, television usage, etc.) and generate a pattern of usage of the devices while in the vacation mode. In an implementation, the system may determine criteria (such as a threshold) for determining when to enter the vacation mode.

A controller and/or remote system for a smart home or home security system, as described below, may establish rules based on a pattern of usage of one or more devices associated with the smart home, sensed user behaviors, and/or devices that are not controlled by the controller (e.g., a smartphone, personal computer, and/or tablet). As an example, a home may contain one or more smart wall switches that may communicate a state (e.g., on/off, percent on) and time thereof to the controller. The controller may determine, based on the occupancy of the house and the time of day, which lights to activate in the home and when to activate them. For example, the controller may determine that the living room lights, if on, should be turned off at 11:30 PM if the room is unoccupied. If a user, subsequent to formation of the rule, begins to stay up until 12:00 AM, then the controller may modify the rule to turn off the living room lights at 12:15 AM. A similar learning technique can be applied to wall outlets and/or devices (e.g., TV, stereo, light, dishwasher, coffee-maker, etc.) that can communicate directly or indirectly with the controller. Over time, a pattern of usage of electronic devices in communication with the controller (e.g., smart switches, smart outlets, kitchen appliances, TV, lights, and stereo) can be inferred. In an implementation, the learned behaviors can be replayed when the user is away from the home for an extended period of time (e.g., on vacation).

FIG. 1 is an example process for placing a home security system into a vacation mode as disclosed herein. At 110, a home security system may receive a first indication that a user is not on a premises of a home on a first day. The home security system or smart home is described in detail below with respect to FIGS. 5A-6B. Briefly, the home security system may include one or more sensors that provide data to a controller and/or remote system for the home security system. The home security system may include devices such as lights, TVs, stereos, smart outlets, etc. that are in communication with the controller and/or remote system. For example, a light may be controlled by a smart switch. The light may be controlled through the smart light switch by a signal received from the controller.

Figure 2:
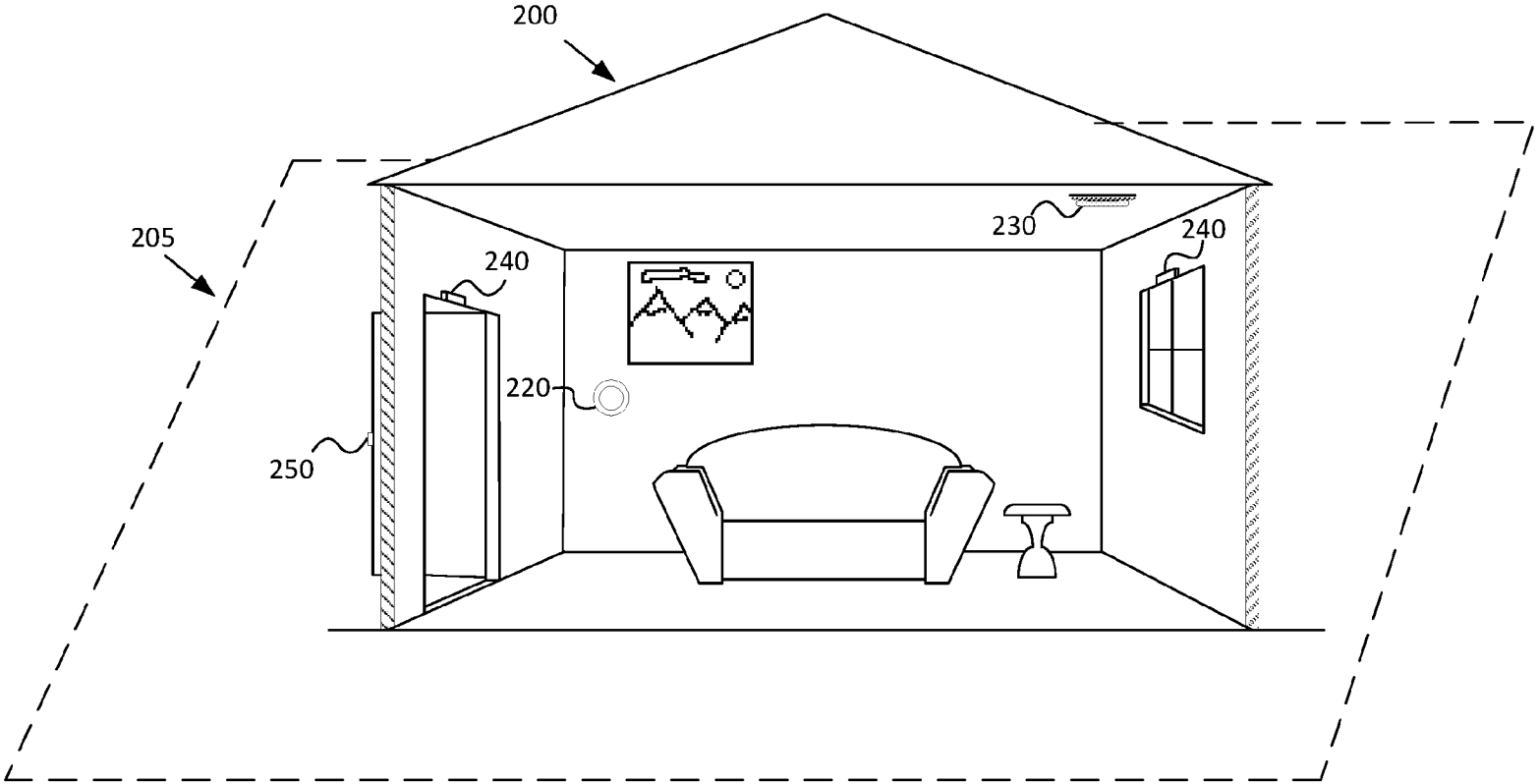
FIG. 2 is an example premises of a home security system is shown as disclosed herein.

The premises of a home may include a perimeter area around the home and the interior space and structural components of the home. The perimeter of the home may circumscribe a lot on which the home is situated. It may exclude public area such as a sidewalk. FIG. 2 is an example premises 200 of a home security system is shown. The premises may have a perimeter 205 that defines the outer bounds of the area observed directly by one or more of the home security system's sensors and/or within which a device can be controlled by the home's security system. The home security system may include one or more thermostats 220, doorbells 250, hazard detection units 230, and entry detection devices 240 that can observe activity over multiple entry points (e.g., a door, a window, a garage door, etc.) into the home. The home security system may receive the data generated by the sensors and determine if a particular security event, user behavior, etc., is occurring or has occurred. The data may be stored by the controller and/or remote system and utilized as a basis of comparison to later-collected data. For example, the system may observe an occupancy pattern for users in a home. The pattern may change during summer months as compared to the fall and spring months due to the users being outside, around, and/or away from the home more during summer months compared to other months and some of the users being out of school. The system may determine a seasonal schedule based on the occupancy patterns during weekdays. For example, the users of the house may utilize lights, kitchen appliances, and a TV at later time points of weekdays (e.g., the usage may occur from 9:00 AM-11:00 AM during the summer instead of briefly at 5:30 AM during days in which school is in session).

The first indication that a user is not on a premises at 110 may be based upon one or more signals received from one or more sensors located on the premises of the home and/or a client device associated with the system. For example, a client device (e.g., a smartphone) may contain a GPS sensor that (with a user's permission) can communicate its location coordinates to a remote system associated with the home security system. The controller may determine at least approximately when the client device crosses a boundary or enters or leaves a given area and determine that the user is away based on the received GPS signal. Similarly, the system may predict the user's likely destination based on the path the user takes away from the home. For example, the user may travel to work using two or three routes. The system may determine these routes are routes related to the user's work based on the end point signal being the same, the time of arrival and time of departure being approximately similar, the days on which the trips occur (e.g., weekdays), the frequency of the trips, etc. Based on a comparison to a user's current path and the "work" path, the system may predict the user is traveling to work. It may transition the home security system from the home mode to the away mode based on its determination that the user is traveling the work. The system may improve the confidence of such a determination based on data from other sensors and devices. For example, if the user takes a container such as a briefcase to work, the system can sense when the briefcase leaves the premises. The sensed departure of the briefcase shortly before the detection of the user on a "work" route can enhance the system's confidence that the user is at work.

Other sensor data may be utilized to indicate that the user is leaving or not on the premises. The security system may observe an entry point being opened and then closed. For example, the garage door may open and close within a two-minute span suggesting that the user has left. In some configurations, the system may detect that an entry door has been opened from the inside. For example, a motion detector may observe motion of one or more individuals that proceeds in a direction towards the door. This may be followed by detection of the door opening, a determination that it is being opened from the inside, the absence of motion being detected on the interior of the room, and new motion being detected in an area at the exterior of the home. These events may be observed by one or more sensors associated with the controller and/or remote system of the home security system within a relatively short span of time. Based on the timing of the departure, the system may infer that the home will be unoccupied for a period of time. A user may manually instruct the home security system to be placed into an away mode as the user is leaving the premises as well.

While implementations disclosed herein may be illustrated with examples that describe a single user, the system may observe patterns of behaviors for more than one occupant of a home. For example, the system can simultaneously observe and learn behaviors from members of a family of four that may occupy a home. For example, the family members may have a particular pattern of usage of lights. The usage of the lights, irrespective of the number of individuals in the home, may be learned for a particular time of day and/or room. Similarly, any of the users who have devices connected to the system may relay coordinates of their devices to the system.

Deviations from a learned behavior may be expected and can influence a learned rule for the behavior if the frequency of the deviation crosses a threshold. For example, if a user takes a ten-minute detour to go to a store while taking a learned path that the system determines is a route to work, this may not cause a change in the learned rule. However, if for example, the user begins to deviate to a donut shop every morning while on the way to work, the "work" path may be modified to include the donut shop. The threshold for modifying the rule may vary based on the volume and recency of the data relevant to the original rule. For example, a one year "work" path may not be modified by a one week or even one month deviation. However, a deviation that occurs over five weeks with regularity may cause the system to modify the existing rule and/or to generate a new rule that includes the original work path plus the deviation. Similarly, the threshold to establish a rule or to train the system for a particular behavior may depend upon the type of behavior, frequency of the behavior, and recency of the behavior.

Returning to FIG. 1, the home security system may be placed into an away mode based on the first indication at 120. As stated above, a variety of signals may indicate to the system that a user is leaving the premises and the home should be secured from intrusion. The system may combine indications from multiple sensors and/or devices to place the system into the away mode. For example, an occupancy of the home may be determined based on one or motion sensors. Similarly, the system may utilize smart switches to determine if any lights are on in the house, suggesting a presence in the home. In the event it detects a light on, the system may deactivate the light and observe if the light is turned on shortly thereafter (indicating that the home is occupied). The away mode, as described earlier, may cause the home security system to observe doors and/or windows for a security event such as an intrusion (e.g., breaking glass heard by a microphone, motion detected inside/outside the home, movement of a door/window detected by a compass/accelerometer, etc.) and/or abnormality such as a fire hazard. The away mode may specify a first response for the security event. For example, in the event the system identifies an intrusion, it may generate a silent alarm by sending a notice to a user's client device and to a law enforcement group. The silent alarm may begin storing video and audio captured by one or more interior cameras and microphones. The silent alarm may be delayed thirty seconds in the away mode to allow a user to return to disarm or deactivate the system (e.g., by entering a security PIN into a keypad or by sending a signal to the system from an authorized user's smartphone).

The home security system may receive the first indication on a second day at 130. For example, it may detect that the user leaves by a front door and has left the premises because it detects motion on the interior of the home, opening and closing of the front door, motion on the outside of the home near the front door, and then no motion. The home security system may be placed into the away mode based on the first indication at 140. The user's behavior may be consistent with the user departing for work as at 120. However, the user may not return home at the expected time. For example, the home may be determined to be unoccupied.

The system may determine that the user will not return for an extended time based on a second indication at 150. The second indication may be based on a comparison of a learned behavior compared to the current detected behavior, a GPS signal from a client device, data generated by one or more sensors, etc. An extended time may be relative to a particular user and/or household. It may refer to time that a user (or household occupants) are on vacation. As an example, occupancy habits of a single user occupying a home may be observed on a regular basis. If there are regular patterns of non-occupancy lasting a night or two every month and those trips occur during weekdays, then the system may establish a rule for determining an extended absence that indicates any 24 hour absence on the weekend and any 72 hour absence on weekdays from the premises may be deemed an extended period of time. In contrast, a different user may only be absent from the premises for one day each month. The threshold for that particular user for the extended time may be a 16 hour absence from the premises. Thus, the system may determine that a user will not return to the premises for an extended time by comparing the learned behavior to the current behavior. The current behavior may be received as a second indication (e.g., motion data indicate that the home is unoccupied). The vacation threshold (e.g., extended time) may vary based on the particular user and/or occupants of a home. For example, if there are four occupants of a home, it is less likely that there will be more than one day on which the home is determined to be entirely unoccupied. In such a case, a less than 24 hour period of non-occupancy may be sufficient for the system to determine that the "user" will not return for an extended time at 150. At 160, the home security system may be placed into a vacation mode based on the determination.

Figure 3:
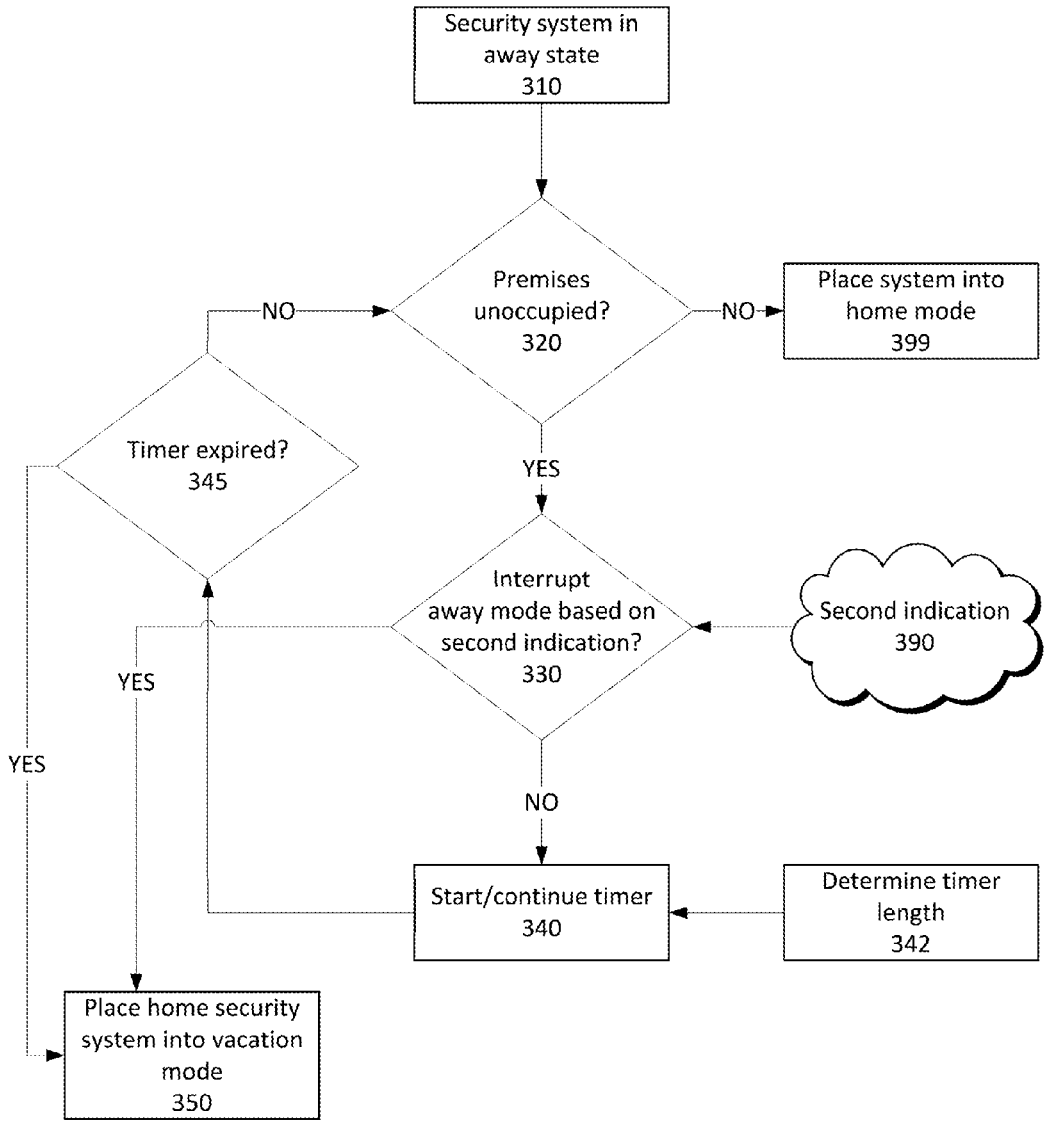
FIG. 3 illustrates different processes by which a transition to a vacation mode can be made immediately and/or delayed depending on the second indication that is received as disclosed herein.

Depending on the second indication received by the system for the determination at 150, the system can transition to a vacation mode relatively quickly or slowly. The previous examples may require the system to detect non-occupancy and wait until a threshold amount of time has passed before the system can determine that an extended time has been reached at 150. FIG. 3 is illustrative of different processes by which a transition to a vacation mode can be made immediately and/or delayed depending on the second indication that is received. At 310, the system may be in an away state. The system may observe the premises at 320 to determine whether it is occupied by an authorized user. In some configurations, the system may determine if the premises are about to be occupied. For example, a client device of a user of the home may be determined to have crossed a geofence or be within one kilometer of the premises based on GPS signals from the client device. The system may infer that the user intends to arrive at home. It may, therefore, determine that the premises should be maintained in the away state at 310 until the user actually arrives on the premises. If the premises are occupied by an authorized occupant at 320, then the system may transition to a home state. An authorized occupant may be determined to be on the premises, for example, if the correct PIN is entered into a keypad for a door, a garage door is opened, the client device of the user connects to the home network and provides a credential (e.g., a device ID) to the system and/or the user enters PIN on the client device, etc. The system may automatically transition to the home mode 399 in such an instance.

At 320, the premises may be determined to be unoccupied. The away mode may be interrupted based on a second indication 390 that is receive at 330. For example, they system may determine that the user has deviated from an learned behavior for an away mode. For example, the GPS data associated with the user's client device may indicate that the user has crossed a geofence for an airport, failed to return home at an expected time, and/or has taken a path that is deviated from the "work" path as described above. As another example of a second indication at 390 that can interrupt immediately the away mode at 330, a user may purchase airline tickets through an email account that is associated with the remote system and the home security system. The dates of the airline tickets may be utilized as a basis for determining the user's travel plans. If the system detects the user on a path towards the airport and/or that the user has crossed a geofence for the airport, it may place the system into a vacation mode at 350. As yet another example, a user may manually configure the home security system to enter the vacation mode. This may be received as an interrupt to the away mode at 330.

In the event that there is not a second indication by which the system can clearly determine that the user will be absent from the premises for an extended time at 330, then the system may start a timer at 340. The length of the timer (e.g., the threshold for the timer) may be based on a learned behavior for a particular user and/or household at 342 as described above. The system may determine if the timer has expired (or crossed the threshold) at 345. If the timer has crossed the threshold, then the home security system may be placed into the vacation mode at 350. For example, the timer may be determined to be 24 hours at 342. If the timer has not expired at 345 then the system may again attempt to ascertain whether the premises are occupied at 320 and, if not, whether there is a reason to interrupt the away mode at 330. If the timer has already been initiated at 340, the timer may continue to count down (or up in configurations that utilize a threshold time amount). The timer may be reset once the system enters the vacation mode and/or the home mode.

Returning to FIG. 1, the home security system may be placed into the vacation mode at 160. The vacation mode may define a second response for the security event. The second response may be different than the first response. For example, in the event the system identifies a potential intrusion (e.g., a security event) while in the away mode, the system may delay a response to the identified intrusion for 30 seconds to provide the user adequate time to enter a deactivation PIN or the like. In the vacation mode, however, the system may alarm immediately in the event of an intrusion. As another example, in the away mode, the system may notify the user of an intrusion. The same intrusion may result in a notice being generated for a different individual or group. As another example, an intrusion in the away mode may result in a silent alarm that dispatches a notice to one or more parties. In the vacation mode, the system may generate a visual and/or audio cue (e.g., flashing lights and/or warning sounds) in the event of an intrusion.

The vacation mode and the away mode may differ in the manner by which the home security system analyzes sensor data and/or manipulation of devices controlled by the smart home or home security system. For example, in the away mode, the system may not activate interior lights. In contrast, in the vacation mode, the system may turn on lights in different rooms of the house according to a light usage pattern that the system has learned to make the house appear to be occupied to an outside observer. The pattern may be varied between different nights and according to other factors such as weather. For example, if the weather for the day is expected to be rainy, the system may activate interior lights according to a pattern of usage it may have learned from other rainy days during which the home was occupied. As another example, the HVAC may be adjusted to a lower temperature during the winter or fall seasons and a higher temperature during the spring and summer seasons in the vacation mode to conserve energy consumption. The HVAC may be adjusted relative to the current temperature outside and/or the expected temperature for the day. In the away mode, the system may utilize HVAC according to a different program from that of the vacation mode. For example, during the winter in the vacation mode, the HVAC may not turn on until the temperature is below 15.5 degrees Celsius. In the away mode, however, the system may not activate the HVAC until the temperature is below 17.8 degrees Celsius. In the home mode, the user may have specified, via a smart thermostat, that the temperature should be 20.0 degrees Celsius. Thus, the system may learn a user's behavior and utilize the learned behavior in different ways depending on the mode in which the system is operating.

At 170, a security event may be detected using one or more sensors associated with the home security system. A second response may be generated based on the home security system operating in the vacation mode at 180. As described above, the same security event may elicit a different response in the away mode compared to the vacation mode. The response may be provided at 190. In some configurations, the response may be provided to a user, a third party (e.g., a home security company), a law enforcement group, a fire department, etc.

The home security system may transition between the away mode and the vacation mode based on a user's expected time of return. In an implementation, an expected time of return for the user may be determined based on an indication received by the controller of the smart home. The indication may be, as described above, a GPS signal, an email, a personal calendar to which the smart home has access, a manually indicated return time, etc. As an example, the system may be operating in the vacation mode. It may expect a user to return from the airport on a Sunday morning. On Sunday, when the user crosses the geofence for the airport, the system may transition the home security system to the away mode. In some configurations, the system may wait to transition to the away mode until the user is on the premises of the home.

Figure 4:
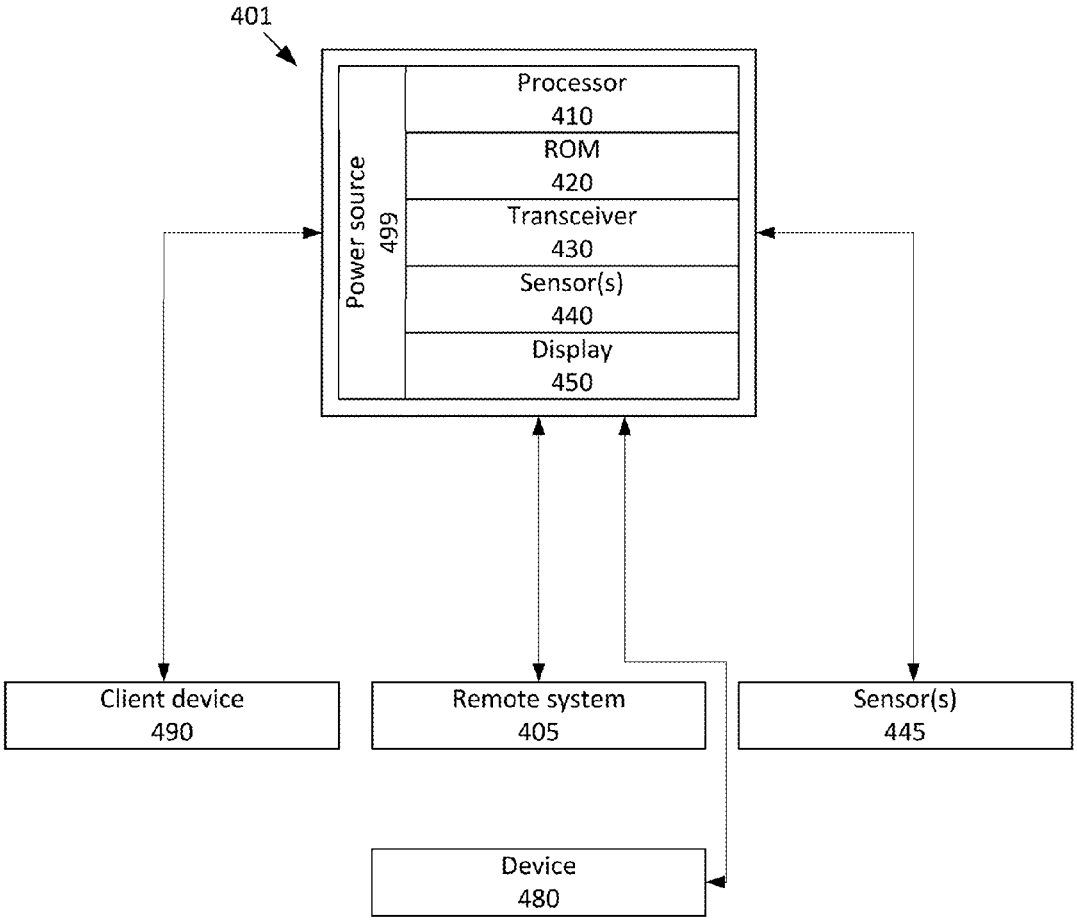
FIG. 4 is an example of a home security system that may include one or more sensors and a processor communicatively coupled thereto as disclosed herein.

FIG. 4 is an example of a home security system that may include one or more sensors 440, 445 and a processor 410 communicatively coupled thereto. The sensors 440, 445 may observe the premises of a home for a security event (e.g., an intrusion and/or abnormality) as describe above. The controller 401 may contain a sensor itself such as a thermostat, a light sensor, etc. The controller may communicate via the transceiver 430 with other sensors 445, a client device 490, a remote system 405, and other household devices 480 such as appliances, lights, smart switches, smart outlets, etc. In some implementations, the controller 401 may also include a read-only memory (ROM) 420 and a display 450 communicatively coupled to the processor 410, and a power source 499 that supplies power to the processor 410, the ROM 420, the transceiver 430, the sensor 440, and the display 450.

The processes of the home security system are described in the context of the controller 401, but the remote system 405 may perform some or all of the processes disclosed herein. The remote system 405 is described in detail with respect to FIGS. 5A-6B below. The processor 410 may be configured to receive a first indication that a user is not on the premises of the home on a first day as described above. The processor 410 may place the home security system into an away mode based on the first indication. The processor 410 may receive the first indication on a second day. The indications may be based on data generated by one or more sensors 440, 445 and/or data input into the system from the client device 490, the user, and/or the remote system 405. The processor 410 may place the home security system into the away mode based on the first indication as described above. The processor 410 may be configured to determine that the user will not return for an extended time based on a second indication as described above. It may place the home security system into a vacation mode.

A security event may be detected based on an analysis of the data generated by the sensors (e.g., a door is opened from the outside when there are no authorized users nearby). The processor 410 may generate the second response based on the home security system operating in the vacation mode and provide the second response.

Implementations disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, entry, presence, pressure, light, sound, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. A sensor also may be described in terms of a function or functions the sensor performs within an integrated sensor network, such as a smart home environment as disclosed herein. For example, a sensor may operate as a security sensor when it is used to determine security events such as unauthorized entry. A sensor may operate with different functions at different times, such as where a motion sensor is used to control lighting in a smart home environment when an authorized user is present, and is used to alert to unauthorized or unexpected movement when no authorized user is present, or when an alarm system is in an "armed" (e.g., away) state, or the like. In some cases, a sensor may operate as multiple sensor types sequentially or concurrently, such as where a temperature sensor is used to detect a change in temperature, as well as the presence of a person or animal. A sensor also may operate in different modes at the same or different times. For example, a sensor may be configured to operate in one mode during the day and another mode at night. As another example, a sensor may operate in different modes based upon a state of a home security system or a smart home environment, or as otherwise directed by such a system.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor, a sensor device, or a sensor package. For clarity, sensors are described with respect to the particular functions they perform and/or the particular physical hardware used, when such specification is necessary for understanding of the implementations disclosed herein.

Figure 5A:
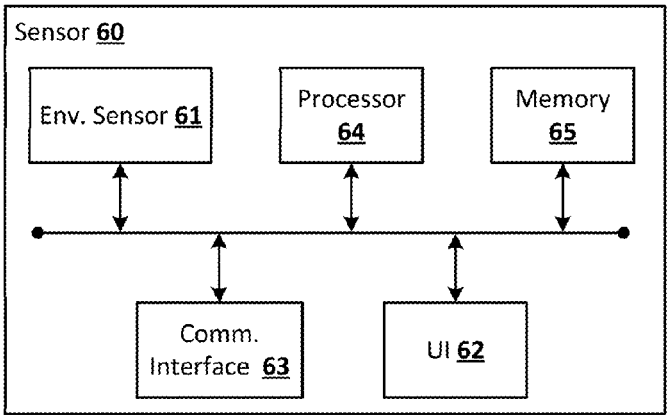
FIG. 5A shows an example sensor as disclosed herein.

A sensor may include hardware in addition to the specific physical sensor that obtains information about the environment. FIG. 5A shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like may allow for communication by the sensor 60 with other devices. A user interface (UI) 62 may provide information and/or receive input from a user of the sensor. The UI 62 may include, for example, a speaker to output an audible alarm when an event is detected by the sensor 60. Alternatively, or in addition, the UI 62 may include a light to be activated when an event is detected by the sensor 60. The user interface may be relatively minimal, such as a liquid crystal display (LCD), light-emitting diode (LED) display, or limited-output display, or it may be a full-featured interface such as a touchscreen. Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

In some configurations, two or more sensors may generate data that can be used by a processor of a system to generate a response and/or infer a state of the environment. For example, an ambient light sensor in a room may determine that the room is dark (e.g., less than 60 lux). A microphone in the room may detect a sound above a set threshold, such as 60 dB. The system processor may determine, based on the data generated by both sensors that it should activate one or more lights in the room. In the event the processor only received data from the ambient light sensor, the system may not have any basis to alter the state of the lighting in the room. Similarly, if the processor only received data from the microphone, the system may lack sufficient data to determine whether activating the lights in the room is necessary, for example, during the day the room may already be bright or during the night the lights may already be on. As another example, two or more sensors may communicate with one another. Thus, data generated by multiple sensors simultaneously or nearly simultaneously may be used to determine a state of an environment and, based on the determined state, generate a response.

Figure 6A:
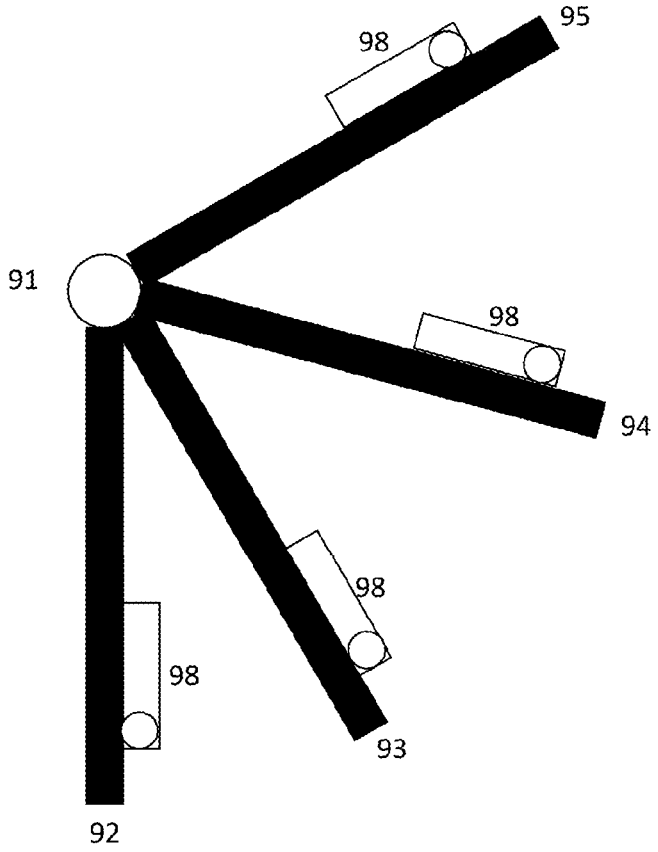
FIG. 6A shows a schematic representation of an example of a door that opens by a hinge mechanism as disclosed herein.

As another example, a security system may employ a magnetometer affixed to a doorjamb and a magnet affixed to the door. When the door is closed, the magnetometer may detect the magnetic field emanating from the magnet. If the door is opened, the increased distance may cause the magnetic field near the magnetometer to be too weak to be detected by the magnetometer. If the security system is activated, it may interpret such non-detection as the door being ajar or open. In some configurations, a separate sensor or a sensor integrated into one or more of the magnetometer and/or magnet may be incorporated to provide data regarding the status of the door. For example, an accelerometer and/or a compass may be affixed to the door and indicate the status of the door and/or augment the data provided by the magnetometer. FIG. 6A shows a schematic representation of an example of a door that opens by a hinge mechanism 91. In the first position 92, the door is closed and the compass 98 may indicate a first direction. The door may be opened at a variety of positions as shown 93, 94, 95. The fourth position 95 may represent the maximum amount the door can be opened. Based on the compass 98 readings, the position of the door may be determined and/or distinguished more specifically than merely open or closed. In the second position 93, for example, the door may not be far enough apart for a person to enter the home. A compass or similar sensor may be used in conjunction with a magnet, such as to more precisely determine a distance from the magnet, or it may be used alone and provide environmental information based on the ambient magnetic field, as with a conventional compass.

Figure 6B:
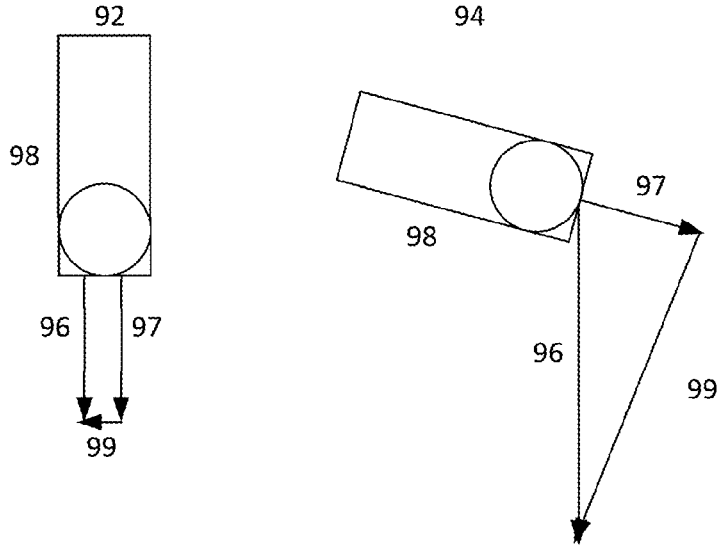
FIG. 6B shows a compass in two different positions that are illustrated in FIG. 8A, according to implementations disclosed herein.

FIG. 6B shows a compass 98 in two different positions, 92, 94, from FIG. 6A. In the first position 92, the compass detects a first direction 96. The compass's direction is indicated as 97 and it may be a known distance from a particular location. For example, when affixed to a door, the compass may automatically determine the distance from the doorjamb or a user may input a distance from the doorjamb. The distance representing how far away from the doorjamb the door is 99 may be computed by a variety of trigonometric formulas. In the first position 92, the door is indicated as not being separate from the doorjamb (i.e., closed) 99. Although features 96 and 97 are shown as distinct in FIG. 6B, they may overlap entirely. In the second position 94, the distance between the doorjamb and the door 99 may indicate that the door has been opened wide enough that a person may enter. Thus, the sensors may be integrated into a home security system, mesh network (e.g., Thread), or work in combination with other sensors positioned in and/or around an environment.

In some configurations, an accelerometer may be employed to indicate how quickly the door is moving. For example, the door may be lightly moving due to a breeze. This may be contrasted with a rapid movement due to a person swinging the door open. The data generated by the compass, accelerometer, and/or magnetometer may be analyzed and/or provided to a central system such as a controller 73 and/or remote system 74 as previously described. The data may be analyzed to learn a user behavior, an environment state, and/or as a component of a home security or home automation system. While the above example is described in the context of a door, a person having ordinary skill in the art will appreciate the applicability of the disclosed subject matter to other implementations such as a window, garage door, fireplace doors, vehicle windows/doors, faucet positions (e.g., an outdoor spigot), a gate, seating position, etc.

Data generated by one or more sensors may indicate a behavior pattern of one or more users and/or an environment state over time, and thus may be used to "learn" such characteristics. For example, data generated by an ambient light sensor in a room of a house and the time of day may be stored in a local or remote storage medium with the permission of an end user. A processor in communication with the storage medium may compute a behavior based on the data generated by the light sensor. The light sensor data may indicate that the amount of light detected increases until an approximate time or time period, such as 3:30 PM, and then declines until another approximate time or time period, such as 5:30 PM, at which point there is an abrupt increase in the amount of light detected. In many cases, the amount of light detected after the second time period may be either below a dark level of light (e.g., under or equal to 60 lx) or bright (e.g., equal to or above 400 lx). In this example, the data may indicate that after 5:30 PM, an occupant is turning on/off a light as the occupant of the room in which the sensor is located enters/leaves the room. At other times, the light sensor data may indicate that no lights are turned on/off in the room. The system, therefore, may learn that occupants patterns of turning on and off lights, and may generate a response to the learned behavior. For example, at 5:30 PM, a smart home environment or other sensor network may automatically activate the lights in the room if it detects an occupant in proximity to the home. In some implementations, such behavior patterns may be verified using other sensors. Continuing the example, user behavior regarding specific lights may be verified and/or further refined based upon states of, or data gathered by, smart switches, outlets, lamps, and the like.

Sensors as disclosed herein may operate within a communication network, such as a conventional wireless network, and/or a sensor-specific network through which sensors may communicate with one another and/or with dedicated other devices. In some configurations, one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 5B:
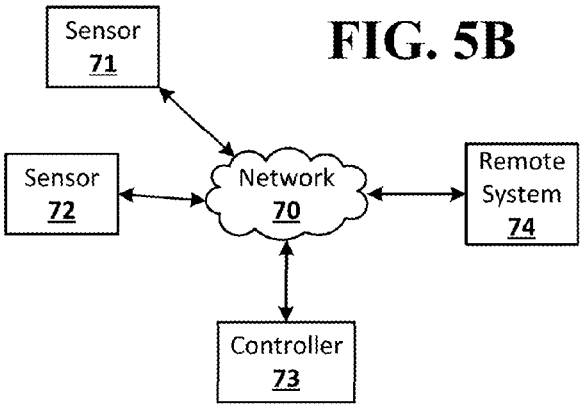
FIG. 5B shows an example of a sensor network as disclosed herein.

FIG. 5B shows an example of a sensor network as disclosed herein, which may be implemented over any suitable wired and/or wireless communication networks.

One or more sensors 71, 72 may communicate via a local network 70, such as a Wi-Fi or other suitable network, with each other and/or with a controller 73. The controller may be a general- or special-purpose computer such as a smartphone, a smartwatch, a tablet, a laptop, etc. The controller may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. In some configurations, the system may have multiple controllers 74 such as where multiple occupants' smartphones and/or smartwatches are authorized to control and/or send/receive data to or from the various sensors 71, 72 deployed in the home. Alternatively or in addition, sensors may communicate directly with a remote system 74. The remote system 74 may, for example, aggregate data from multiple locations, provide instruction, software updates, and/or aggregated data to a controller 73 and/or sensors 71, 72.

The devices of the security system and smart-home environment of the disclosed subject matter may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail and prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol that may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The sensor network shown in FIG. 5B may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 5B may include a plurality of devices, including intelligent, multi-sensing, network-connected devices, that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 5B.

For example, a smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 5B, and the controller 73 may control the HVAC system (not shown) of the structure.

As another example, a smart hazard detector may detect the presence of a hazardous substance or a substance indicative of a hazardous substance (e.g., smoke, fire, flood, or carbon monoxide). For example, smoke, fire, and/or carbon monoxide may be detected by sensors 71, 72 shown in FIG. 5B, and the controller 73 may control an alarm system to provide a visual and/or audible alarm to the user of the smart-home environment.

As another example, a smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some implementations, the smart-home environment of the sensor network shown in FIG. 5B may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 71, 72 shown in FIG. 5B. A smart wall switch may detect ambient lighting conditions, and control a power and/or dim state of one or more lights. For example, a sensor such as sensors 71, 72, may detect ambient lighting conditions, and a device such as the controller 73 may control the power to one or more lights (not shown) in the smart-home environment. Smart wall switches may also control a power state or speed of a fan, such as a ceiling fan. For example, sensors 72, 72 may detect the power and/or speed of a fan, and the controller 73 may adjust the power and/or speed of the fan, accordingly. Smart wall plugs may control supply of power to one or more wall plugs (e.g., such that power is not supplied to the plug if nobody is detected to be within the smart-home environment). For example, one of the smart wall plugs may control supply of power to a lamp (not shown).

In implementations of the disclosed subject matter, a smart-home environment may include one or more intelligent, multi-sensing, network-connected entry detectors (e.g., "smart entry detectors"). Such detectors may be or include one or more of the sensors 71, 72 shown in FIG. 5B. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some implementations of the disclosed subject matter, the alarm system, which may be included with controller 73 and/or coupled to the network 70 may not be placed in an away mode (e.g., "armed") unless all smart entry detectors (e.g., sensors 71, 72) indicate that all doors, windows, entryways, and the like are closed and/or that all smart entry detectors are in an away mode. In some configurations, such as the door example shown in FIGS. 6A and 6B, the system may be placed in an away mode (e.g., arm) if it can be determined that the distance the door (or window) is ajar is insubstantial (e.g., the opening is not wide enough for a person to fit through).

The smart-home environment of the sensor network shown in FIG. 5B can include one or more intelligent, multi-sensing, network-connected doorknobs (e.g., "smart doorknob"). For example, the sensors 71, 72 may be coupled to a doorknob of a door (e.g., doorknobs located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of a smart-home environment (e.g., as illustrated as sensors 71, 72 of FIG. 5B) can be communicatively coupled to each other via the network 70, and to the controller 73 and/or remote system 74 to provide security, safety, and/or comfort for the smart home environment.

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, or the like). A webpage or application can be configured to receive communications from the user and control the one or more of the network-connected smart devices based on the communications and/or to present information about the device's operation to the user. For example, the user can view or change the mode of the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment may "learn" who is a user (e.g., an authorized user) and permit the electronic devices associated with those individuals to control the network-connected smart devices of the smart-home environment (e.g., devices communicatively coupled to the network 70), in some implementations including sensors used by or within the smart-home environment. Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

A smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event that any of the network-connected smart devices, such as smart wall plugs located outdoors, detect movement at nighttime, the controller 73 and/or remote system 74 can activate the outdoor lighting system and/or other lights in the smart-home environment.

Figure 5C:
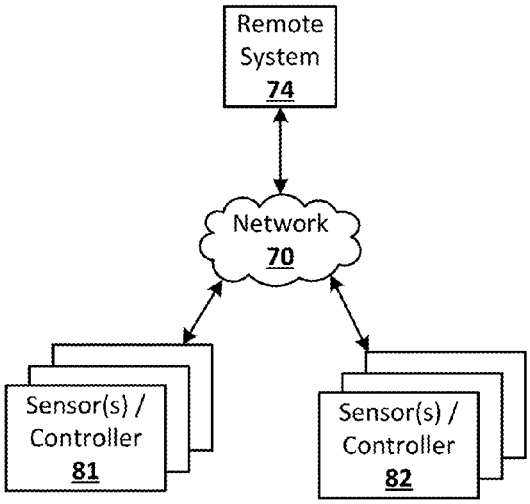
FIG. 5C shows an example configuration of sensors, one or more controllers, and a remote system as disclosed herein.

In some configurations, a remote system 74 may aggregate data from multiple locations, such as multiple buildings, multi-resident buildings, and individual residences within a neighborhood, multiple neighborhoods, and the like. In general, multiple sensor/controller systems 81, 82 as previously described with respect to FIG. 5B may provide information to the remote system 74 as shown in FIG. 5C. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. As another example, systems disclosed herein may allow a user to restrict the information collected by the systems disclosed herein to applications specific to the user, such as by disabling or limiting the extent to which such information is aggregated or used in analysis with other information from other users. Thus, the user may have control over how information is collected about the user and used by a system as disclosed herein.

Figure 7A:
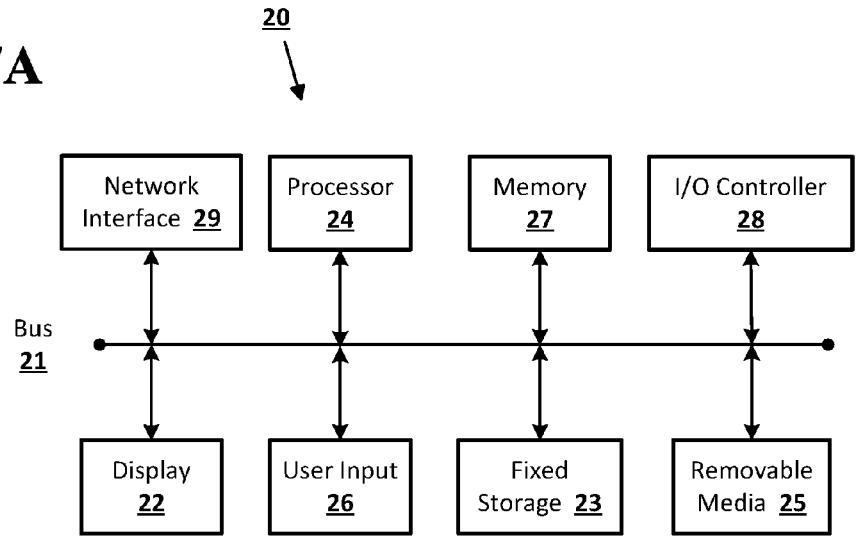
FIG. 7A shows a computer according to an implementation of the disclosed subject matter.

Implementations of the presently disclosed subject matter may be implemented in and used with a variety of component and network architectures. FIG. 7A is an example computer 20 suitable for implementations of the presently disclosed subject matter. The computer 20 includes a bus 21 which interconnects major components of the computer 20, such as a central processor 24, a memory 27 (typically RAM, but which may also include ROM, flash RAM, or the like), an input/output controller 28, a user display 22, such as a display screen via a display adapter, a user input interface 26, which may include one or more controllers and associated user input devices such as a keyboard, mouse, and the like, and may be closely coupled to the I/O controller 28, fixed storage 23, such as a hard drive, flash storage, Fibre Channel network, SAN device, SCSI device, and the like, and a removable media component 25 operative to control and receive an optical disk, flash drive, and the like.

The bus 21 allows data communication between the central processor 24 and the memory 27, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) that controls basic hardware operation such as the interaction with peripheral components. Applications resident with the computer 20 are generally stored on and accessed via a computer readable medium, such as a hard disk drive (e.g., fixed storage 23), an optical drive, floppy disk, or other storage medium 25.

The fixed storage 23 may be integral with the computer 20 or may be separate and accessed through other interfaces. A network interface 29 may provide a direct connection to a remote server via a telephone link, to the Internet via an Internet service provider (ISP), or a direct connection to a remote server via a direct network link to the Internet via a POP (point of presence) or other technique. The network interface 29 may provide such connection using wireless techniques, including digital cellular telephone connection, Cellular Digital Packet Data (CDPD) connection, digital satellite data connection, or the like. For example, the network interface 29 may allow the computer to communicate with other computers via one or more local, wide-area, or other networks, as shown in FIG. 7B.

Many other devices or components (not shown) may be connected in a similar manner (e.g., document scanners, digital cameras, and so on). Conversely, all of the components shown in FIG. 7A need not be present to practice the present disclosure. The components can be interconnected in different ways from that shown. The operation of a computer such as that shown in FIG. 7A is readily known in the art and is not discussed in detail in this application. Code to implement the present disclosure can be stored in computer-readable storage media such as one or more of the memory 27, fixed storage 23, removable media 25, or on a remote storage location.

Figure 7B:
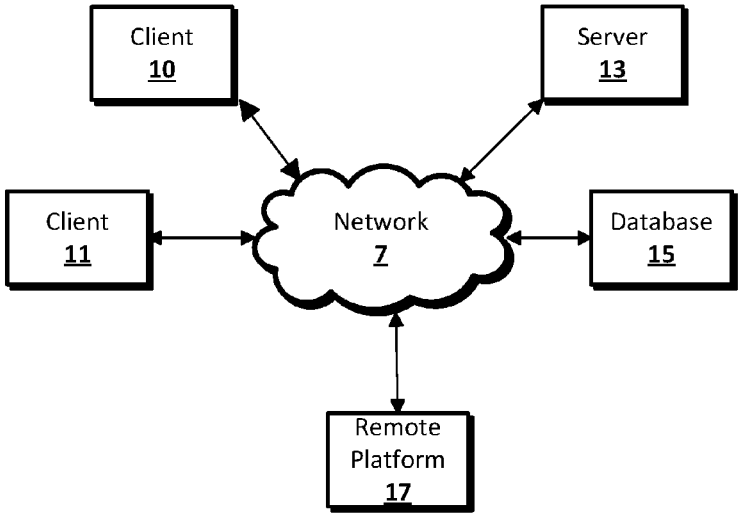
FIG. 7B shows a network configuration according to an implementation of the disclosed subject matter.

FIG. 7B shows an example network arrangement according to an implementation of the disclosed subject matter. One or more clients 10, 11, such as local computers, smart phones, tablet computing devices, and the like may connect to other devices via one or more networks 7. The network may be a local network, wide-area network, the Internet, or any other suitable communication network or networks, and may be implemented on any suitable platform including wired and/or wireless networks. The clients may communicate with one or more servers 13 and/or databases 15. The devices may be directly accessible by the clients 10, 11, or one or more other devices may provide intermediary access such as where a server 13 provides access to resources stored in a database 15. The clients 10, 11 also may access remote platforms 17 or services provided by remote platforms 17 such as cloud computing arrangements and services. The remote platform 17 may include one or more servers 13 and/or databases 15.

More generally, various implementations of the presently disclosed subject matter may include or be implemented in the form of computer-implemented processes and apparatuses for practicing those processes. The disclosed subject matter also may be implemented in the form of a computer program product having computer program code containing instructions implemented in non-transitory and/or tangible media, such as floppy diskettes, CD-ROMs, hard drives, USB (universal serial bus) drives, or any other machine readable storage medium, wherein, when the computer program code is loaded into and executed by a computer, the computer becomes an apparatus for practicing implementations of the disclosed subject matter. Implementations also may be implemented in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing implementations of the disclosed subject matter. When implemented on a general-purpose microprocessor, the computer program code segments configure the microprocessor to create specific logic circuits. In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions.

Implementations may use hardware that includes a processor, such as a general-purpose microprocessor and/or an Application Specific Integrated Circuit (ASIC) that includes all or part of the techniques according to implementations of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to implementations of the disclosed subject matter.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A computer-implemented method, comprising:

receiving, by a home security system, a first indication that a user is not on a premises of a home within a first period of time;

placing the home security system into an away mode based on the first indication, wherein the away mode defines a first response for a security event;

determining that the premises is unoccupied within a second period of time;

placing the home security system into the away mode based on the determination that the premises is unoccupied within the second period of time;

determining, by the home security system, within the second period of time, whether a second indication that the user will not return for an extended time is present;

based on a determination that the second indication is present within the second period of time, placing the home security system into a vacation mode, wherein the vacation mode defines a second response for the security event, the second response being different from the first response;

based on a determination that the second indication is not present within the second period of time, initiating a timer that has a start time and an expiration time;

determining whether the premises is unoccupied between the start time and the expiration time;

based on a determination that the premises is unoccupied between the start time and the expiration time, placing the home security system into the vacation mode at the expiration time;

detecting the security event;

generating the second response based on the home security system operating in the vacation mode; and providing the second response.

2. The method of claim 1, wherein the second indication comprises an indication selected from the group consisting of a location of the user based on at least one of GPS signal, a calendar event, an email event, and a user-provided indication.

3. The method of claim 1, wherein the second response is selected from the group consisting of a notice, a visual cue, and an audio cue.

4. The method of claim 1, wherein the security event is selected from the group consisting of a fire, a flood and an intrusion.

5. The method of claim 1, further comprising determining an expected return time of the user.

6. The method of claim 1, wherein the second indication comprises an indication selected from the group consisting of:

an indication, by a mobile device carried by the user, that the user has crossed a geofence at a location remote from the premises;

an indication, by the mobile device, that the user has deviated from a traffic path associated with a normal commute;

an indication that the user has failed to return to the premises at an expected time; and an indication, by an email account associated with the user, of a planned time of remote travel by the user.

7. The method of claim 5, further comprising placing the home security system into the away mode based on the expected return time of the user.

8. A home security system, comprising:

a plurality of sensors that observe a premises of a home for a security event;

a processor communicatively coupled to the plurality of sensors of the home, the processor configured to:

receive a first indication that a user is not on a premises of a home on a first day within a first period of time;

place the home security system into an away mode based on the first indication, wherein the away mode defines a first response for the security event;

determine that the premises is unoccupied within a second period of time;

place the home security system into the away mode based on the first indication the determination that the premises is unoccupied within the second period of time;

determine, within the second period of time, whether a second indication that the user will not return for an extended time is present;

based on a determination that the second indication is present within the second period of time, place the home security system into a vacation mode, wherein the vacation mode defines a second response for the security event, the second response being different from the first response;

based on a determination that the second indication is not present within the second period of time, initiate a timer that has a start time and an expiration time;

determine whether the premises is unoccupied between the start time and the expiration time;

based on a determination that the premises is unoccupied between the start time and the expiration time, place the home security system into the vacation mode at the expiration time;

detect the security event;

generate the second response based on the home security system operating in the vacation mode; and provide the second response.

9. The system of claim 7, wherein the second indication comprises an indication selected from the group consisting of a location of the user based on at least one of GPS signal, a calendar event, an email event, and a user-provided indication.

10. The system of claim 8, wherein the second response is selected from the group consisting of a notice, a visual cue, and an audio cue.

11. The system of claim 8, wherein the security event is selected from the group consisting of a fire and an intrusion.

12. The system of claim 8, further comprising determining an expected return time of the user.

13. The system of claim 8, wherein the second indication comprises an indication selected from the group consisting of:

an indication, by a mobile device carried by the user, that the user has crossed a geofence at a location remote from the premises;

an indication, by the mobile device, that the user has deviated from a traffic path associated with a normal commute;

an indication that the user has failed to return to the premises at an expected time; and an indication, by an email account associated with the user, of a planned time of remote travel by the user.

14. The system of claim 12, further comprising placing the home security system into the away mode based on the expected return time of the user.

* * * * *